US006016411A

United States Patent [19]

Kimura et al.

[11] Patent Number: 6,016,411

[45] Date of Patent: Jan. 18, 2000

[54] EFFICIENT DEVELOPMENT OF AN ELECTROSTATIC LATENT IMAGE

[75] Inventors: Takahiko Kimura, Ikoma; Yoshiki Ichikawa, Kashihara; Jun Yamaguchi, Ikoma; Masahiro Tsuji, Nara; Yoshiaki Sanada, Ikoma, all of Japan

[73] Assignee: Sharp Kabushiki Kaisha, Osaka, Japan

[21] Appl. No.: 09/094,986

[22] Filed: Jun. 15, 1998

[30] Foreign Application Priority Data

Jun. 16, 1997 [JP] Japan ..... 9-158326

[51] Int. Cl.[7] ..... G03G 15/08

[52] U.S. Cl. ..... 399/103; 399/236

[58] Field of Search ..... 399/102, 103, 399/236, 252

[56] References Cited

U.S. PATENT DOCUMENTS

| | | | |
|---|---|---|---|
| 4,155,329 | 5/1979 | Tsukamoto et al. | 399/103 |
| 4,963,930 | 10/1990 | Yoshimaru et al. | 399/103 |
| 5,024,181 | 6/1991 | Shoji et al. | 399/167 |

FOREIGN PATENT DOCUMENTS

| | | |
|---|---|---|
| 4-107485 | 4/1992 | Japan . |
| 4-70663 | 6/1992 | Japan . |
| 10-3220 | 1/1998 | Japan . |

*Primary Examiner*—Joan Pendegrass
*Attorney, Agent, or Firm*—Birch, Stewart, Kolasch & Birch, LLP

[57] ABSTRACT

A developing apparatus comprises a development housing containing developer and disposed opposite to a carrier for carrying a latent image, and a developing roller rotatably provided in the development housing and rotatively driven in a predetermined direction. The developer in the development housing is carried by the developing roller and the developer carried by the developing roller is applied to the carrier through an opening formed in the development housing. A rotation speed Fβ of the developing roller is higher than a movement speed Fα of the carrier. A gap β between an opening downstream side wall portion of the development housing and the developing roller is greater than a gap α between the opening downstream side wall portion and the carrier.

11 Claims, 2 Drawing Sheets

EFFICIENT DEVELOPMENT OF AN ELECTROSTATIC LATENT IMAGE

BACKGROUND OF THE INVENTION

1. Field of the Invention

The present invention relates to a developing apparatus for making visible a latent image carried on a carrier, and more particularly, to a developing apparatus improved so that scattering of developer from the developing apparatus is prevented.

2. Description of the Related Art

An electrophotographic image forming apparatus such as a copier and a printer has a rotary drum having a photoreceptor as a carrier, and a developing apparatus is disposed opposite to the rotary drum. On the surface of the photoreceptor of the rotary drum, an electrostatic latent image is formed by electrophotography. The developing apparatus applies developer containing toner as a colorant to the electrostatic latent image formed on the photoreceptor, so that the toner adheres to the electrostatic latent image to make the latent image visible.

The toner image developed by th e d eve loping apparatus is transferred to a sheet of paper as a transfer material. After transfer, some toner that cannot be transferred remains on the photosensitive surface. The remaining unnecessary toner is removed from the surface of the photoreceptor before successively performing the next image formation. For that purpose, a cleaner is provided for removing the toner remaining on the surface of the photoreceptor. The unnecessary toner removed by the cleaner is collected into a collecting portion in the cleaner.

Such a developing apparatus has a development housing disposed opposite to the photoreceptor on which an electrostatic latent image is formed, and a developing roller which is rotated in a predetermined direction is disposed in the development housing. The developing roller holds developer in the development housing and conveys the developer to a development area that is opposite to the photoreceptor member. The developer carried by the developing roller acts on the surface of the photoreceptor in the development area. The development housing has an opening in correspondence with the development area. The developer carried by the developing roller is applied to the surface of the photoreceptor through the opening. After the electrostatic latent image is developed, the developer carried by the developing roller is collected into the development housing, mixed with the developer in the development housing, and used again.

However, there is a possibility that after development, some of the developer carried by the developing roller scatters outside through a gap between the development housing and the photoreceptor. When the developer scatters, the scattering developer adheres to a sheet of paper that is being conveyed to form an image thereon, or adheres to a guide member for guiding the conveyance of the sheet, so that the reverse surface of the sheet is smudged with the developer.

Examples of known developing apparatuses improved so that the scattering of the developer after development is prevented include developing apparatuses disclosed in Japanese Unexamined Patent Publication JP-A 4-107485 (1992) and Japanese Unexamined Utility Model Publication JP-U 4-70663 (1992).

In the developing apparatus described in the former prior art, a gap t between the bottom surface of the development housing and the developing roller is greater than a thickness t1 of a layer of the developer adhering to the developing roller. Moreover, by setting the gap t to be as close to t1 as possible, an air flow drawn into the development housing is caused by rotation of the developing roller, whereby developer which is about to scatter is collected into the development housing.

In the developing apparatus described in the latter prior art, a gap ratio t2/t of a gap t2 between the downstream side wall surface of the development housing and the developing roller to the gap t between the developing roller and the bottom surface of the development housing is not less than 0.7 and not more than 1.5. By setting the ratio like this, the scattering developer is drawn into the development housing by the rotation of the developing roller.

These prior art developing apparatuses produce their effects. However, when development is performed, the photoreceptor carrying an electrostatic latent image to be developed rotates as well as the developing roller of the developing apparatus. Consequently, an air flow is caused by the rotation of the photoreceptor, so that the developer which cannot be held by the developing roller scatters out of the development housing with the air flow.

In particular, the photoreceptor on the surface of the rotary drum is rotatively moved at a speed which depends on an image formation speed, and the rotative movement speed increases as the image formation speed increases. In an apparatus which performs image formation on, for example, 60 or more sheets per minute, when it is assumed that image formation can be performed on one sheet every rotation of the rotary drum, the rotative movement speed of the photoreceptor is 60 or more rotations per minute.

When the photoreceptor is moved at such a high speed, it is necessary that developer sufficient for contribution to development be supplied by the developing roller in the developing apparatus. For this reason, the rotation speed of the developing roller is increased as the image formation speed is increased. Consequently, the amount of the developer which cannot be held by the developing roller at the time of development increases, so that such developer scatters out of the developing apparatus with an air flow in the rotation direction of the photoreceptor. Such scattering of the developer cannot be prevented in the prior art developing apparatuses in any way.

SUMMARY OF THE INVENTION

An object of the invention is to provide a developing apparatus in which scattering of developer is prevented based on a relationship between the movement speeds of a developing roller and carrier of the developing apparatus.

Another object of the invention is to provide a developing apparatus in which even if the speed of an image forming apparatus is increased, developer is efficiently prevented from scattering on an air flow in the direction of movement of a carrier and the developer scattering toward the housing in a development area can be collected.

Yet another object of the invention is to provide a developing apparatus enabling stable development without any image quality deterioration.

In a first aspect of the invention, a developing apparatus comprises a development housing containing developer and disposed opposite to a carrier for carrying a latent image, and a developing roller rotatably provided in the development housing and rotatively driven in a predetermined direction. The developer in the development housing is carried by the developing roller and the developer carried by the developing roller is applied to the carrier through an opening formed in the development housing. A rotation speed $F\beta$ of the developing roller is higher than a movement speed $F\alpha$ of the carrier. A gap $\beta$ between the opening downstream side wall portion of the development housing and the developing roller is greater than a gap $\alpha$ between the opening downstream side wall portion and the carrier.

According to the invention, since the rotation speed of the developing roller is higher than the movement speed of the carrier, with respect to air flows in the downstream side in a development area, the amount of air flow into the development housing is greater than the amount of air flow along the carrier, so that the developer separated from the developing roller in the development area is drawn and collected into the development housing. Since the gap between the development housing and the developing roller is greater than the gap between the development housing and the carrier, the action of drawing the developer into the development housing is promoted.

In a second aspect of the invention, a speed ratio K ($K=F\beta/F\alpha$) of the rotation speed $F\beta$ of the developing roller to the movement speed $F\alpha$ of the carrier is set to $1<K<3$.

According to the invention, since the speed ratio K is set to $1<K<3$, the action increases of drawing the developer separated from the developing roller into the development housing in the rotation direction of the developing roller. By setting the rotation speed of the developing roller to be less than three times the movement speed of the carrier, the force to separate the developer due to centrifugal force caused by the rotation of the developing roller does not become excessive, so that it less frequently causes the developer to be separated from the developing roller in excess of the force of the developing roller to hold the developer. Further, since the resistance caused when the developer carried by the developing roller slides over the carrier is reduced, image quality deterioration is prevented such as image flow caused because the developer adhering to the latent image is rubbed.

In a third aspect of the invention, the speed ratio K of the rotation speed $F\beta$ of the developing roller to the movement speed $F\alpha$ of the carrier and a gap ratio T ($T=\alpha/\beta$) of the gap $\alpha$ between the opening downstream side wall portion and the carrier to the gap $\beta$ between the opening downstream side wall portion and the developing roller are set so as to satisfy $T<1/K$.

According to the invention, since the speed ratio K and the gap ratio T are set so as to satisfy $T<1/K$, the developer is nearly completely prevented from scattering from the development housing. As a result, it never causes that sheets of paper and the inside of the image forming apparatus to be smudged with scattered developer.

In a fourth aspect of the invention, the gap $\beta$ between the opening downstream side wall portion and the developing roller is substantially the same as the layer thickness of the developer carried by the developing roller.

According to the invention, since the gap $\beta$ is substantially the same as the layer thickness of the developer carried by the developing roller, the developer carried by the developing roller fills the gap $\beta$ when the developer is collected into the development housing after development. Consequently, the path of an air flow in a direction opposite to the direction of the air flow which is drawn into the development housing is substantially blocked, so that the developer is effectively prevented from scattering out of the development housing with the air flow in the direction opposite to the rotation direction of the developing roller.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
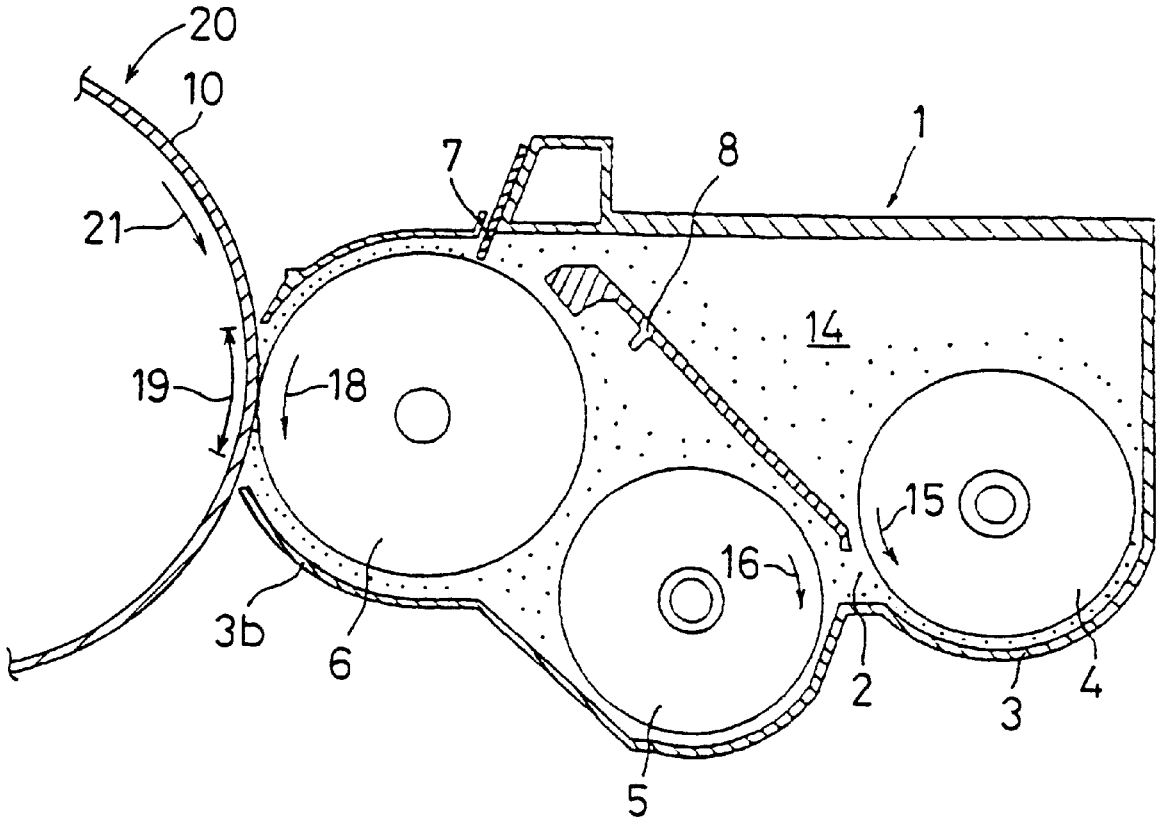
FIG. 1 is a cross-sectional view briefly showing a part of an example of an image forming apparatus having an embodiment of a developing apparatus of the invention.

Now referring to the drawings, preferred embodiments of the invention are described below.

The developing apparatus of the invention is applied to an image forming apparatus, for example, an electrophotographic image forming apparatus. While in the embodiment described below, a developing apparatus according to the invention will be described which is applied to an electrophotographic image forming apparatus, it is needless to say that the invention is widely applicable not only to electrophotographic image forming apparatuses but also to various types of developing apparatuses for making latent images visible.

FIG. 1 shows a part of an image forming apparatus having a developing apparatus of the invention. With reference to the figure, the structure of the image forming apparatus will be briefly described.

In FIG. 1, a reference numeral 1 represents the developing apparatus according to the invention. The developing apparatus 1 has a development housing 3. The development housing 3 defines a developer container 14 which contains developer 2 for developing latent images. The development housing 3 is formed by resin molding. In the developer container 14, agitating/conveying rollers 4, 5 and a developing roller 6 are disposed. The agitating/conveying roller 4 is disposed in a right portion of the developer container 14 in FIG. 1, whereas the developing roller 6 is disposed in a left portion of the developer container 14 in FIG. 1. The agitating/conveying roller 5 is disposed between the agitating/conveying roller 4 and the developing roller 6. The agitating/conveying roller 4, which is rotatively driven in a direction shown by an arrow 15, agitates and conveys the developer 2 and supplies the developer 2 to the agitating/conveying roller 5. The agitating/conveying roller 5, which is rotatively driven in a direction shown by an arrow 16, agitates and conveys the developer 2 and supplies the developer 2 to the developing roller 6. The developing roller 6, which is rotatively driven in a direction shown by an arrow 18, magnetically holds the developer 2 supplied from the agitating/conveying roller 5 and supplies the developer 2 to a development area 19.

The developing apparatus 1 is disposed opposite to a rotary drum 20 of the image forming apparatus. On the periphery of the rotary drum 20, a photosensitive member 10 as a carrier is provided. On a surface of the photoreceptor 10, an electrostatic latent image is formed in accordance with operation of a non-illustrated image formation process before the surface reaches the development area. That is, the photoreceptor 10 is uniformly charged by a charger and after the charging, an image is irradiated onto the photoreceptor 10 with light corresponding to an original image, thereby forming an electrostatic latent image corresponding to the original image on the surface of the photoreceptor 10. In the development area 19, the developer 2 is applied to the electrostatic latent image by rotation of the developing roller 6 of the developing apparatus 1, and thereby the electrostatic latent image is developed. At this time, coloring toner constituting the developer adheres to the electrostatic latent image, so that the latent image is made visible as a toner image.

A non-illustrated sheet of paper is conveyed to a transfer area, and the toner image on the surface of the photoreceptor 10 which has been developed by the developing apparatus 1 is electrostatically transferred to the sheet in the transfer area. Then, the sheet to which the toner image has been transferred is separated from the photoreceptor 10 and sent to heat-fixing means by which the toner image is fixed onto the sheet. Thus, the sheet is finished as a hard copy and discharged out of the image forming apparatus.

After the transfer, some toner which has not been transferred remains on the surface of the photoreceptor 10. The remaining toner is removed by a non-illustrated cleaner and the photoreceptor 10 from which the remaining toner has been removed is ready for the next image formation.

Subsequently, the developing roller 6 and a structure associated therewith will be described with reference mainly to FIG. 3. In the developing roller 6 of this embodiment, as well known, a cylindrical non-magnetic sleeve 6*b* is provided so as to cover a magnet 6*a* including a multiplicity of circumferentially arranged magnetic poles. That is, as shown in an example of the structure of the developing roller 6 in FIG. 3, the developing roller 6 consists of the magnet 6*a* which is fixedly held and the cylindrical non-magnetic sleeve 6*b* which is provided so as to cover the periphery of the magnet 6*a* and rotatively driven in the direction of the arrow 18 in FIGS. 1 and 2 (counterclockwise direction in FIGS. 1 to 3). The magnet 6*a* is magnetized so that the polarities of circumferentially adjoining magnetic poles are opposite to each other.

In the magnet 6*a*, a main pole (development pole) N1 is disposed opposite to the development area which is opposite to the photoreceptor 10 as the carrier. With respect to the main pole N1, auxiliary poles N2 to N4 and S1 to S3 are circumferentially arranged as shown in FIG. 3. Consequently, the developer 2 is magnetically absorbed onto the surface of the sleeve 6*b* by the magnetic force of the magnet 6*a*, conveyed in the direction shown by the arrow 18 by rotation of the sleeve 6*b* in that direction, and supplied to the development area 19. In FIG. 3, the main pole N and the auxiliary poles N2 to N4 are north poles and the auxiliary poles S1 to S3 are south poles.

In a portion of the development housing 3 which is in correspondence with the development area 19, that is, a portion which is opposite to the rotary drum 20, an opening 3*a* is formed. The developing roller 6 is disposed so that a part of the developing roller 6 is exposed through the opening 3*a* of the development housing 3 and so as to be opposed to the photoreceptor 10 rotated in a direction shown by an arrow 21 at the exposed portion. The opposing position of the developing roller 6 is the development area, where the developer 2 conveyed by rotation of the developing roller 6 slides over an electrostatic latent image formed on the surface of the photoreceptor 10, so that toner electrostatically adheres to the electrostatic latent image. In particular, the frictionally electrified toner is attracted by the electrostatic force of the electrostatic latent image, so that the electrostatic latent image is developed.

To the development housing 3, a doctor blade 7 is attached. The doctor blade 7 is disposed above the developing roller 6 (see FIG. 1). The doctor blade 7 acts on the developer 2 held by the developing roller 6 and removes excessive developer 2 so that the amount of the developer 2 is always the same, before the developer 2 reaches the development area where the developer 2 slides over the photoreceptor 10. Thus, the amount of the developer 2 conveyed to the development area, that is, a layer thickness (d) of the developer 2 held on the surface of the developing roller 6 is set by the doctor blade 7. Then, the developer 2 which has been removed from the developing roller 6 by the doctor blade 7 flows down again to a gap between the agitating/conveying rollers 4 and 5 along a flowing plate 8 downwardly extending between the agitating/conveying rollers 4 and 5.

The developer 2 is classified into a two-component type containing carrier and toner, and a one-component type containing only toner. The developer containing only toner is divided into a magnetic type and a non-magnetic type. The non-magnetic one-component toner is not absorbed onto the surface of the developing roller 6 by the magnetic force but can be conveyed in a state of being absorbed onto the surface of the developing roller 6 by use of frictional electrification and the like. In this case, the developing roller 6 is frequently made of rubber. As the developer 2 used for the developing apparatus 1, the above-described various types are applicable.

According to the above-described structure, the developer 2 in the development housing 3 is sufficiently agitated by the agitating/conveying rollers 4 and 5, and charged to have a predetermined polarity, for example, positive polarity. The charged developer 2 is supplied to the developing roller 6 by the action of the agitating/conveying roller 5, absorbed onto the developing roller 6, for example, magnetically, and conveyed to the development area 19 through the opening 3*a* of the development housing 3. The developer 2 conveyed to the development area 19 is regulated to a predetermined amount by the doctor blade 7 and conveyed to the development area in a predetermined layer thickness (d). The developer 2 removed by the doctor blade 7 is returned to the gap between the agitating/conveying rollers 4 and 5 along the flowing plate 8 and agitatively conveyed again.

After development, the developer 2 is collected into the development housing 3 along a bottom plate (wall surface) 3*b* of the development housing 3, scraped off the developing roller 6, agitated by the agitating/conveying rollers 4 and 5, and used again for development. Thus, by rotation of the agitating/conveying rollers 4, 5 and the developing roller 6 as rotary members, toner is charged by friction with the developer and the like, and used for development in succession.

The developer 2 carried by the developing roller 6 is conveyed to the development area 19 which is opposite to the rotating photoreceptor 10, and used for development. However, some of the developer 2 is sometimes separated from the developing roller 6 in the development area 19 without being held by the developing roller 6. The separation of the developer 2 may occur, for example, when the toner is not sufficiently charged, or according to the rotation speed of the developing roller 6 or an air flow caused by rotation of the photoreceptor 10.

Hereinafter, a structure for preventing developer containing toner which can be separated, from scattering outside, that is, from scattering out of the developing apparatus 1 with an air flow will be described in detail.

Figure 2:
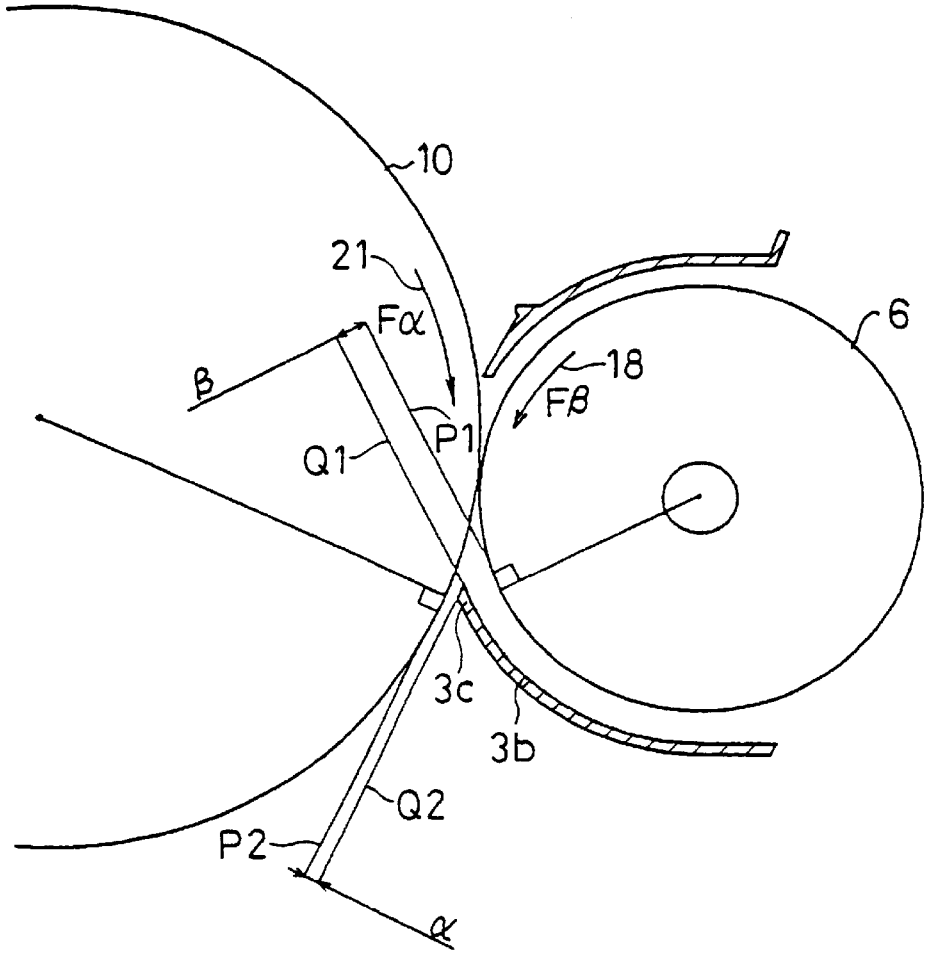
FIG. 2 is a view showing a principal part of the developing apparatus of FIG. 1.

Referring mainly to FIG. 2, in the above-described developing apparatus 1, in order to prevent scattering of the developer 2, particularly, scattering of toner, in association with a relationship between the rotation speed of the photoreceptor 10 and the rotation speed of the developing roller 6, a gap β between the developing roller 6 and an end portion of the bottom plate 3*b* of the development housing 3, that is, an opening downstream side wall portion 3*c* which defines a downstream side portion of the opening 3*a* viewed in the rotation direction of the developing roller 6 shown by the arrow 18 is greater than a gap α between the photoreceptor 10 and the opening downstream side wall portion 3*c* of the bottom plate 3*b* of the development housing 3 (β>α).

Here, the gap β is, as shown in FIG. 2, the distance between a tangential line P1 of the developing roller 6 at a portion opposite to the opening downstream side wall portion 3*c* and an extension line Q1 extending from an end of the opening downstream side wall portion 3*c* of the bottom plate 3*b* of the development housing 3 in a direction parallel to the tangential line P1. Likewise, the gap α is the distance between a tangential line P2 of the photoreceptor 10 at a portion opposite to the opening downstream side wall portion 3*c* and an extension line Q2 extending from the end of the opening downstream side wall portion 3*c* of the bottom plate 3*b* of the development housing 3 in a direction parallel to the tangential line P2.

In this embodiment, in association with the structure described above, the end surface of the opening downstream side wall portion 3*c* of the development housing 3 is formed so as to be substantially parallel to the tangential line P2 of the photoreceptor 10 of the rotary drum 20. By thus forming the end surface, the end of the opening downstream side wall portion 3*c* acutely protrudes at a portion on the developing roller 6 side.

In performing development by use of the developing apparatus 1, the developing roller 6 is rotated in the direction shown by the arrow 18 and the photoreceptor 10 is rotated in the same direction shown by the arrow 21. These rotations cause an air flow through the gap β into the development housing 3 and an air flow through the gap α between the photoreceptor 10 and the bottom plate 3*b* of the development housing 3. For this reason, by drawing into the development housing 3 the toner separated from the developer 2 carried by the developing roller 6 in the development area, toner which scatters through the gap α can be reduced and prevented.

Therefore, by setting the gap β between the developing roller 6 and the opening downstream side wall portion 3*c* of the development housing 3 to be greater than the gap α between the photoreceptor 10 and the opening downstream side wall portion 3 as described above, most of the air flows can be directed into the development housing 3.

At this time, in order to excellently develop the electrostatic latent image formed on the photoreceptor 10 without any deficiency or faint and patchy portion, it is necessary to supply a sufficient amount of developer 2 to the development area 19 by the developing roller 6. For this reason, in order to perform excellent development, since the photoreceptor 10 and the developing roller 6 are rotating in the same direction, by setting the rotation speed (peripheral speed) Fβ of the developing roller 6, the sleeve 6*b* in this embodiment, to be higher than the movement speed (rotation peripheral speed) Fα of the photoreceptor 10, a sufficient amount of developer 2 can be supplied to the development area which is opposite to the photoreceptor 10. In this embodiment, since the photoreceptor 10 makes a rotational movement, the speed of the photoreceptor 10 is referred to as the rotation speed; however, when the photoreceptor 10 makes a linear movement, the speed of the photoreceptor 10 is referred to as a linear movement speed. The phrase, movement speed may include both of the rotation speed and the linear movement speed.

When the rotation speed Fβ of the developing roller 6 is too much higher than the movement speed (rotation speed) Fα of the photoreceptor 10, the rubbing force increases when a brush by the developer 2 rubs against the photoreceptor 10. Consequently, the photoreceptor 10 is rubbed and the toner image adhering to the latent image is disturbed, so that image flow and the like is caused to largely deteriorate the image quality. Further, as the rotation speed Fβ of the developing roller 6 increases, the force to separate toner due to centrifugal force and the like the developer receives by rotation of the developing roller 6 surpasses the force of the developing roller 6 to hold toner as the developer, so that toner is more apt to be separated from the developing roller 6.

Therefore, by setting the speed ratio K (K=Fβ/Fα) of the speed Fβ of the developing roller 6 to the speed Fα of the photoreceptor 10 within a range of 1<K<3, stable development is performed without any image quality deterioration. That is, by setting the speed ratio K to be greater than 1, a sufficient amount of developer 2 is supplied to the development area 19. By setting the speed ratio K to be less than 3, image quality deterioration is prevented while ensuring sufficient restraint for the developing roller 6 to hold the developer.

Under a condition where the speed Fα of the photoreceptor 10 and the speed Fβ of the developing roller 6 are maintained in the above-described relationship of the speed ratio K, by setting the gap α with the photoreceptor 10 to be smaller than the gap β with the developing roller 6, the air flow in the rotation direction of the developing roller 6 increases, which promotes the collection of the developer, particularly toner, separated with the air flow into the development housing 3. This prevents toner and the like separated along the rotation of the photoreceptor 10 from being blown out, so that scattering of toner is reduced and prevented.

The greater the gap β between the developing roller 6 and the opening downstream side wall portion 3*c* of the development hosing 3 becomes, the greater the obtained effect becomes; however, the gap β cannot be filled with the developer 2 carried by the developing roller 6, so that a cause of scattering of toner is produced. That is, with a space being formed between the surface of the developer 2 carried by the developing roller 6 and an inner surface of the bottom plate 3*a* of the development housing 3, an air flow into the development housing 3 is formed with the flow of the developer 2. When air thus flows into the development housing 3, the pressure within the development housing 3 gradually increases. When a large space exists between the surface of the developer 2 and the bottom wall 3*a* of the development housing 3, the air with increased pressure flows backward through the space into the gap α which is along the photoreceptor 10, so that the separated toner is blown out of the development housing 3 with the air flow and scatters, and the amount of the scattered toner increases.

Therefore, related to the amount of the developer 2 carried by the developing roller 6, at least the gap β is set to be substantially the same as the amount carried by the developing roller 6, that is, the same as the layer thickness (d) of the developer 3 regulated by the doctor blade 7, for example, set to approximately 3 mm at the maximum. By thus setting the gap β , from the above-described relationship of the speed ratio K, the effect of toner scattering prevention further increases. However, when the gap β is too much smaller than the layer thickness of the developer 2 carried by the developing roller 6, the effect of drawing into the development housing 3 the toner separated in the development area is decreased, and the developer 2 is rubbed by an end of the bottom plate 3*a*, so that toner scatters out of the developing apparatus 1 at this time. Therefore, the gap β is set to be approximately ±10% of the layer thickness d of the developer 2 carried by the developing roller 6.

In the above-described developing apparatus, by use of the rotation of the developing roller 6, toner and the like which is about to scatter is efficiently collected into the development housing 3 with an air flow caused by the rotation of the developing roller 6. For that purpose, under a condition where the speed ratio K of the speed Fβ of the developing roller 6 to the speed Fα of the photoreceptor 10 is set to be less than 3, the gap β between the developing roller 6 and the opening downstream side wall portion 3*c* is set to be wide. At this time, by setting the gap β to be not more than 3 mm, particularly, by setting the gap β to be substantially the same as the layer thickness of the developer 2 carried by the developing roller 6, the collecting effect is promoted.

Further, in the developing apparatus, it is preferable that the relationship between the speed ratio K (K=Fβ/Fα) of the rotation speed Fβ of the developing roller 6 to the rotation speed Fα of the photoreceptor 10 and a gap ratio T (T=α/β) of the gap α to the gap β be set to satisfy T<1/K. When the gap ratio T is 1/K or higher, the gap α between the photoreceptor 10 and the opening downstream side wall portion 3*c* of the development housing 3 increases relatively, so that the amount of air flowing through the gap α increases. As a result, toner scatters outside because of the air flow.

According to the above-described developing apparatus, the scattering of the developer is prevented with simple means, so that the developer which is about to scatter is efficiently collected into the development housing. Since the developer which is about to scatter is collected by use of rotation of the developing roller, the scattering of the developer is efficiently prevented even when the image formation speed is high. Consequently, neither the inside of the image forming apparatus nor sheets of paper are smudged with the developer, and image quality deterioration never occurs.

While an electrophotographic image forming apparatus has been described as the developing apparatus 1 in the above-described embodiment, the invention is applicable not only to this type of image forming apparatus but also to a developing apparatus of a type which performs development simultaneously with image exposure. That is, the invention is applicable to an image forming apparatus in which a photoconductive layer is formed on a light transmitting conductive layer as the photoreceptor, the developing apparatus is disposed opposite to the photoconductive layer and a light image is irradiated from the side of the light transmitting conductive layer to thereby develop a latent image generated by a change in resistance.

EXAMPLE

In order to confirm the effect of the developing apparatus according to the above-described embodiment of the invention, a test as described below was performed as an example.

Figure 3:
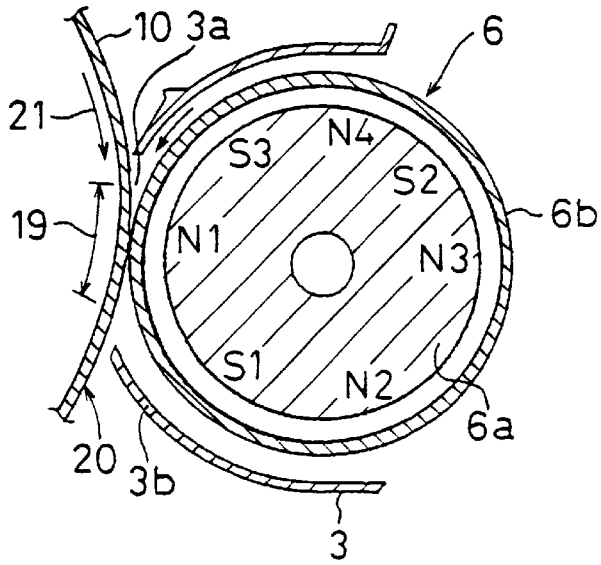
FIG. 3 is a cross-sectional view showing the structure of a developing roller of FIG. 1.

As the developing apparatus, one having the structure shown in FIG. 3 was used. The outer diameter of the sleeve of the developing roller was 60 mm. The internal magnet includes seven poles as shown in the figure. The magnetic forces of the poles of the magnet were as follows: a main pole N1 serving as a development pole, 1000 gausses; an auxiliary pole N2, 800 gausses; an auxiliary pole N3, 600 gausses; an auxiliary pole N4, 500 gausses; an auxiliary pole S1, 800 gausses; an auxiliary pole S2, 500 gausses; and an auxiliary pole S3, 950 gausses. The developing roller, that is, the sleeve was rotatively driven at a peripheral speed (Fβ) of 1000 mm/sec.

With respect to the photoreceptor where electrostatic latent images are to be formed and developed, the diameter (outer diameter of the rotary drum) was 110 mm, and the rotation speed, that is, the peripheral speed Fα was 400 mm/sec.

In association with the speeds Fβ and Fα of the developing roller and the photoreceptor, the gap β between the opening downstream side wall portion of the development housing and the developing roller shown in FIG. 2 was set to 3 mm and the gap α between the opening downstream side wall portion and the photoreceptor was set to 1 mm. The layer thickness (d) of the developer carried by the developing roller was set to approximately 3 mm.

Under the above-mentioned conditions, an electrostatic latent image formed by uniformly charging the photoreceptor and performing image exposure is developed by the developing apparatus and the toner image obtained through the development is transferred to an A4-size sheet to obtain a hard copy. The speed of copy thus obtained was 80 sheets per minute. After development is performed for one hundred thousand sheets, the following points were checked: smudges of the inside of the image forming apparatus due to scattering of toner; smudges of a guide and the like by which the sheets are guided; and smudges of the obverse and reverse surfaces of the sheets.

As a result of the test, the inside of the image forming apparatus was hardly smudged by the scattered toner and the sheets were not smudged with the conveying guide. Further, no toner smudge was recognized on the obtained sheets of hard copies. Thus, excellent hard copies were obtained and no image quality deterioration was found.

As a result, it was confirmed that the scattering of toner can be prevented by setting the gap β with the developing roller to be not more than 3 mm under a condition where the speed ratio K between the photoreceptor and the developing roller is set to be 1 or more and less than 3.

It was also confirmed that from the relationship of the gap ratio T (T=α/β) of the gap α to the gap β and the relationship of the speed ratio K, the effect of preventing scattering of toner is increased by setting the gap α nd speed ratios T and K to satisfy T<1/K. That is, the speed ratio K was less than 3, and by setting the gap ratio T to be lower than 1/K, toner did not scatter but was efficiently collected in the development housing. For example, in the above-described embodiment, the speed ratio K is 2.5 and the gap β in the developing roller 6 was maximized. By setting the gap β to 3 mm, the gap ratio T can be set to be lower than 1/2.5 (0.4), so that the above-described excellent result was obtained.

Comparative Example

In order to confirm scattering of toner when the gap ratio α/β and the speed ratio K are set as to satisfy T<1/K, tests as described below were performed as comparative examples.

As a first comparative example, a developing apparatus 1 similar to that of the above-described example was used, and the gap α between the photoreceptor of the rotary drum and the opening downstream side wall portion of the development housing was set to 3 mm. Other conditions being the same as those of the above-described example, one hundred thousand sheets of hard copies were obtained. As a result, the inside of the image forming apparatus was smudged with toner. As for the sheets of paper, although smudges were not conspicuous on the first two thousand sheets, smudges gradually became conspicuous after development was performed on the three thousandth sheet.

Moreover, as a second comparative example, setting the gap $\alpha$ to 2 mm, one hundred thousand sheets of hard copies were obtained in a manner similar to the first comparative example. As a result, although smudges with toner were halved, the obtained result was incomparably inferior to the result obtained in the above-described example.

Further, as a third comparative example, setting the gap $\alpha$ to 1.5 mm, one hundred thousand sheets of hard copies were obtained in a manner similar to the first comparative example. As a result, smudges with toner were further reduced.

As described above, when the gap ratio T and the speed ratio K do not satisfy the relationship of $T<1/K$, with respect to the air flows caused by rotation of the developing roller and the photoreceptor, the amount of air flow passing through the gap $\alpha$ between the opening downstream side wall portion of the development housing and the photoreceptor increases, so that separated toner scatters with the air flow.

Therefore, by setting the speed ratio K and the gap ratio T to satisfy the relationship of $T<1/K$, scattering of toner is prevented. Thus, the problem of smudges with toner is solved.

Since toner adheres to the electrostatic latent image, in order that the adhering toner is not disturbed, the gap $\alpha$ with the photoreceptor is set so that the end of the bottom plate of the development housing does not come into contact with the adhering toner. Consequently, the gap $\alpha$ is set to be not less than 0.1 mm, for example, approximately 1 mm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A development apparatus comprising:

a carrier for carrying a latent image;

a development housing for containing a developer therein, disposed opposite to the carrier for carrying a latent image;

a developing roller provided rotatably in the development housing to be rotated in a predetermined direction, wherein the developer in the development housing is carried by the developing roller and the developer carried by the developing roller is applied to the carrier through an opening formed in the development housing, and wherein a rotation speed $F\beta$ of the developing roller is higher than a movement speed $F\alpha$ of the carrier;

a gap $\beta$ disposed between an opening downstream of a side wall portion of the development housing and the developing roller; and a gap $\alpha$ disposed between the opening downstream of a side wall portion of the developing housing and the carrier, wherein the gap $\beta$ is larger than the gap $\alpha$, wherein a speed ratio K ($K=F\beta/F\alpha$) of $F\beta$ to $F\alpha$ and a gap ratio T ($T=\alpha/\beta$) of the gap $\alpha$ to the gap $\beta$ is so as to satisfy $T<1/K$.

2. The developing apparatus of claim 1, wherein a speed ratio K ($K=F\beta/F\alpha$) of the rotation speed $F\beta$ of the developing roller to the movement speed $F\alpha$ of the carrier is set to $1<K<3$.

3. A development apparatus comprising:

a carrier for carrying a latent image;

a development housing for containing a developer therein, disposed opposite to the carrier for carrying a latent image;

a developing roller provided rotatably in the development housing to be rotated in a predetermined direction, wherein the developer in the development housing is carried by the developing roller and the developer carried by the developing roller is applied to the carrier through an opening formed in the development housing, and wherein a rotation speed $F\beta$ of the developing roller is higher than a movement speed $F\alpha$ of the carrier;

a gap $\beta$ disposed between an opening downstream of a side wall portion of the development housing and the developing roller; and a gap $\alpha$ disposed between the opening downstream of a side wall portion of the development housing and the carrier, wherein the gap $\beta$ is larger than the gap $\alpha$, wherein the gap $\beta$ is substantially the same as a layer thickness of the developer carried by the developing roller.

4. The developing apparatus of claims 1 or 3, wherein the carrier is a photoreceptor provided on a peripheral surface of a rotary drum, wherein an end face of the opening downstream side wall portion is formed to be substantially parallel to a tangent line to a portion of the rotary drum, opposed to the opening downstream side wall portion, wherein the gap $\alpha$ is a gap between the portion of the rotary drum and the end face of the opening downstream side wall portion.

5. The developing apparatus of claims 1 or 3, wherein a rotation direction of the developing roller is the same as a moving direction of the carrier.

6. The developing apparatus of claims 1 or 3, wherein the developing roller includes a sleeve rotatably disposed to be opposed to the carrier and a magnet disposed in the sleeve, and the sleeve is rotatively driven in a predetermined direction at the rotation speed $F\beta$.

7. The apparatus of claim 6, wherein the magnet comprises a multiplicity of circumferentially arranged magnetic poles.

8. The apparatus of claims 1 or 3, wherein a developer container is defined inside the development housing.

9. The apparatus of claim 8, further comprising:

a first agitating/conveying roller disposed in a right hand portion of the of the developer container; and a second agitating/conveying roller disposed between the first agitating/conveying roller and the developing roller.

10. The apparatus of claim 9 wherein the second agitating/conveying roller rotates in a direction the same as both the first agitating/conveying roller and the developer roller.

11. The apparatus of claims 1 or 3, further comprising:

a doctor blade attached to the development housing, wherein the doctor blade is disposed above the developing roller.

* * * * *